US007106981B2

(12) United States Patent
Hashimoto et al.

(10) Patent No.: US 7,106,981 B2
(45) Date of Patent: Sep. 12, 2006

(54) IMAGE FORMING APPARATUS

(75) Inventors: Junichi Hashimoto, Toyohashi (JP); Kyoichi Yoshizawa, Nagoya (JP); Hiroshi Mizuno, Aichi-ken (JP); Tomoyuki Imura, Toyohashi (JP); Hiromasa Ueno, Toyokawa (JP); Takanobu Yamada, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 5 days.

(21) Appl. No.: 10/788,312

(22) Filed: Mar. 1, 2004

(65) Prior Publication Data

US 2005/0069334 A1 Mar. 31, 2005

(30) Foreign Application Priority Data

Sep. 25, 2003 (JP) ..... 2003-333322

(51) Int. Cl.
*G03G 15/00* (2006.01)

(52) U.S. Cl. ..... 399/25; 399/53; 399/66; 399/83

(58) Field of Classification Search ..... 399/24, 399/25, 27, 28, 53, 66, 297, 298, 299, 302, 399/82, 83
See application file for complete search history.

(56) References Cited

U.S. PATENT DOCUMENTS 6,029,023 A 2/2000 Munemori et al.
6,580,523 B1 * 6/2003 Yoshimoto et al. ..... 358/1.4
6,636,711 B1 * 10/2003 Katahira ..... 399/82
6,788,907 B1 * 9/2004 Burkes et al. ..... 399/82
6,836,630 B1 * 12/2004 Owen et al. ..... 399/112
6,865,355 B1 * 3/2005 Burkes et al. ..... 399/85
2003/0038955 A1 2/2003 Yamada et al.

FOREIGN PATENT DOCUMENTS

JP 2003-57911 2/2003

* cited by examiner

*Primary Examiner*—Diego Gutierrez
*Assistant Examiner*—Amy R. Cohen
(74) *Attorney, Agent, or Firm*—Morrison & Foerster LLP

(57) ABSTRACT

An image forming apparatus includes a plurality of printing units each having an image bearing member for rotation about an axis and a process member which cooperates with the image bearing member in an image forming process; a transfer member for moving in contact with the image bearing member of each of the plurality of printing units, an image on each of the image bearing members being transferred onto the transfer member or a recording medium that is transported on the transfer member; a switch unit for switching between a contact state where the image bearing members in the plurality of printing units are in contact with the transfer member and a separate state where the image bearing member(s) in the printing unit(s) other than one of the plurality of printing units are separated from the transfer member; a memory for storing life expectancies of the image bearing member and the process member with regard to the printing unit(s) other than the one of the plurality of printing units; and a control section for controlling the switch unit based on a print job and the life expectancies stored in the memory.

10 Claims, 8 Drawing Sheets

IMAGE FORMING APPARATUS

RELATED APPLICATION

This application is based on Japanese Patent Application No. 2003-333322, the content of which being incorporated herein by reference.

BACKGROUND OF THE INVENTION

1. Field of the Invention

The present invention relates to an image forming apparatus such as printer, copying machine, facsimile or multi-function peripheral having functions of printing, copying, faxing and the like, and more particularly a tandem-type color image forming apparatus.

2. Description of the Related Art

There has been known a tandem-type color image forming device in which four photoreceptor drums for cyan, magenta, yellow and black are aligned along an intermediate transfer belt. Cyan, magenta, yellow and black toner images are first formed on the photoreceptor drums, respectively, and then transferred onto the intermediate transfer belt (which is referred to as primary transfer process) such that they overlap each other to form a color toner image. Next, the color toner image is carried by the intermediate transfer belt to a nip between the belt and a transfer roller pressed against the belt. The color toner image is transferred onto a sheet which passes through the nip (which is referred to as secondary transfer process), so that a color image is formed on the sheet.

The device described above generally has a color mode where the four toners are used and a monochrome mode where one toner (typically, black toner) is used. In the color mode, all the photoreceptor drums are in contact with the intermediate transfer belt (contact state) in the primary transfer process. In the monochrome mode, on the other hand, only one of the photoreceptor drums (typically, for black) is in contact with the intermediate transfer belt while the others are separated from the belt (separate state). Such switching can prevent an unwanted consumption of process members (e.g. photoreceptor drum or developing device). For example, if a photoreceptor drum that does not serve to form a monochrome image keeps in contact with the intermediate transfer belt in the monochrome mode, an abrasion of the surface of the photoreceptor drum might be accelerated. Accordingly, where a print job containing color and monochrome documents is executed, the photoreceptor drums and the intermediate transfer belt are required to be switched between the contact and the separate states, depending on which of the color mode or the monochrome mode has been selected. However, when an image forming operation is started during or immediately after the switching process, a possible vibration of the intermediate transfer belt due to the switching process might result in image noise. In particular, when the device is switched from the monochrome mode to the color mode, one or more photoreceptor drums are brought into contact with the intermediate transfer belt, which produces a vibration leading to an inappropriate overlapping of color toners on the belt or an irregular pitch between adjacent line images on the belt. However, if the next image forming operation is started after the vibration of the intermediate transfer belt is completely stopped, productivity is greatly reduced.

To minimize such productivity reduction, US Patent Application Publication No. 2003/0038955 A1 discloses an image forming device in which a color image forming operation is started with a delay of a predetermined period of time after the device has been switched from a state where the photoreceptor drums that do not serve to form a monochrome image are separated from the intermediate transfer belt to a state where all the photoreceptor drums are in contact with the belt.

However, such image forming device inevitably reduces productivity where a print job is executed in which monochrome document(s) and color document(s) are alternately printed in the order of printing.

SUMMARY OF THE INVENTION

The object of the present invention is to provide an image forming apparatus which enables an image of high quality to be formed without reducing productivity even where a print job is executed in which monochrome document(s) and color document(s) are alternately printed in the order of printing.

To achieve the above object, an aspect of the present invention is an image forming apparatus that includes a plurality of printing units each including an image bearing member for rotation about an axis and a process member which cooperates with the image bearing member in an image forming process; a transfer member for moving in contact with the image bearing member of each of the plurality of printing units, an image on each of the image bearing members being transferred onto the transfer member or a recording medium that is transported on the transfer member; a switch unit for switching between a contact state where the image bearing members in the plurality of printing units are in contact with the transfer member and a separate state where the image bearing member(s) in the printing unit(s) other than one of the plurality of printing units are separated from the transfer member; a memory for storing life expectancies of the image bearing member and the process member with regard to the printing unit(s) other than said one of the plurality of printing units; and a control section for controlling the switch unit based on a print job and the life expectancies stored in the memory.

With this apparatus, the image bearing members and the transfer member are switched between the contact state and the separate state based not upon information as to whether each document to be printed is color or monochrome but upon information about the life expectancies of the image bearing member and the process member with regard to the printing unit(s) other than the printing unit for monochrome. Therefore, even where a print job is executed in which monochrome document(s) and color document(s) are alternately printed in the order of printing, if the life expectancies of the image bearing member and the process member satisfy a predetermined condition, the image bearing members and the transfer member need not be switched from the contact to the separate states each time a color document is followed by a monochrome document. Likewise, the image bearing members and the transfer member need not be switched from the separate to the contact states each time a monochrome document is followed by a color document.

Preferably, the image bearing member which is in contact with the transfer member is pressed against the latter.

Herein, the term "monochrome document" designates a document to be printed with one of the plurality of printing units and is not limited to a black-and-white document which is to be printed with a printing unit for black.

BRIEF DESCRIPTION OF THE DRAWINGS

The above-mentioned and other objects, advantages and features of the invention will become apparent from the following description thereof taken in conjunction with the accompanying drawings in which.

DETAILED DESCRIPTION OF THE PREFERRED EMBODIMENTS

With reference to the drawings, preferred embodiments of the present invention will be described hereinafter. In the description, although the terminology indicating directions (e.g. "upper", "lower", "right", "left" or others containing these terms) are conveniently used just for clarity, it should not be interpreted that those terminology limit the scope of the present invention.

First Embodiment

Figure 1:
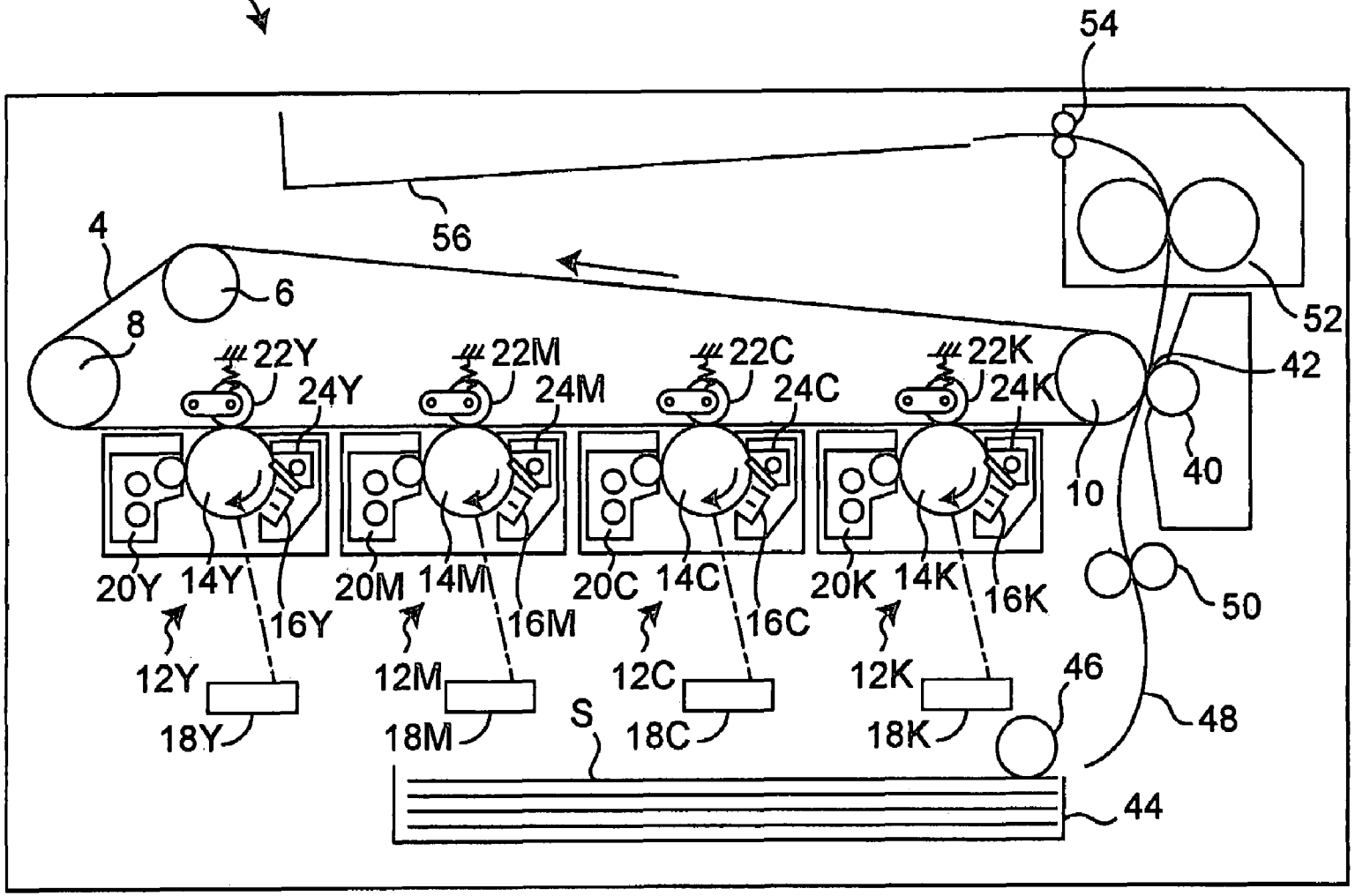
FIG. 1 is a schematic diagram of a first embodiment of the image forming device according to the present invention.

Referring to FIG. 1, there is shown a tandem-type color printer, which is a first embodiment according to the present invention. The printer, generally indicated at reference number 2, includes an intermediate transfer belt 4 as transfer member, which is located generally at the center of the interior thereof. The intermediate transfer belt 4 is supported by the circumferences of three rollers 6, 8 and 10. The roller 6 is a tension roller that provides tension to the intermediate transfer belt 4. The roller 10 is operatively connected with a drive motor not shown. The rotation of the roller 10 causes the rollers 6 and 8 to rotate so that the intermediate transfer belt 4 is rotated in the counterclockwise direction of the drawing.

Four printing units 12Y, 12M, 12C and 12K for yellow (Y), magenta(M), cyan(C) and black(K), respectively, are arranged along the intermediate transfer belt 4 under the lower horizontal portion of the belt 4.

As image bearing members, the printing units 12Y, 12M, 12C and 12K include photoreceptor drums 14Y, 14M, 14C and 14K, respectively. Around the photoreceptor drums 14Y, 14M, 14C and 14K, charging devices 16Y, 16M, 16C and 16K, exposing devices 18Y, 18M, 18C and 18K, developing devices 20Y, 20M, 20C and 20K, primary transfer rollers 22Y, 22M, 22C and 22K, and cleaning devices 24Y, 24M, 24C and 24K are positioned in this order along the rotational direction (clockwise direction of the drawing) of the drums 14Y, 14M, 14C and 14K, respectively. The primary transfer rollers 22Y, 22M, 22C and 22K are mounted for rotation adjacent to the corresponding photoreceptor drums 14Y, 14M, 14C and 14K to form nip regions therewith, allowing the intermediate transfer belt 4 to be moved through the nip regions. In the embodiment shown, the photoreceptor drums 14Y–14K, the charging devices 16Y–16K, the developing devices 20Y–20K and the cleaning devices 24Y–24K in the printing units 12Y–12K are unitized, respectively.

Figure 2:
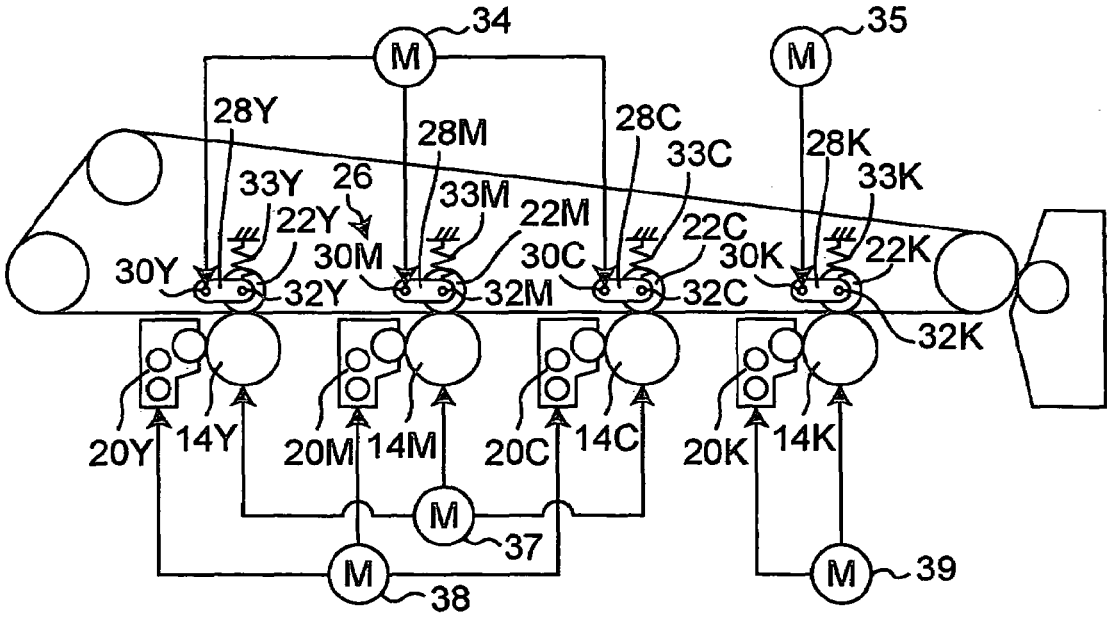
FIG. 2 is a partial view of FIG. 1 showing a pressure contact state where all or four photoreceptor drums are in pressure contact with the intermediate transfer belt.
Figure 3:
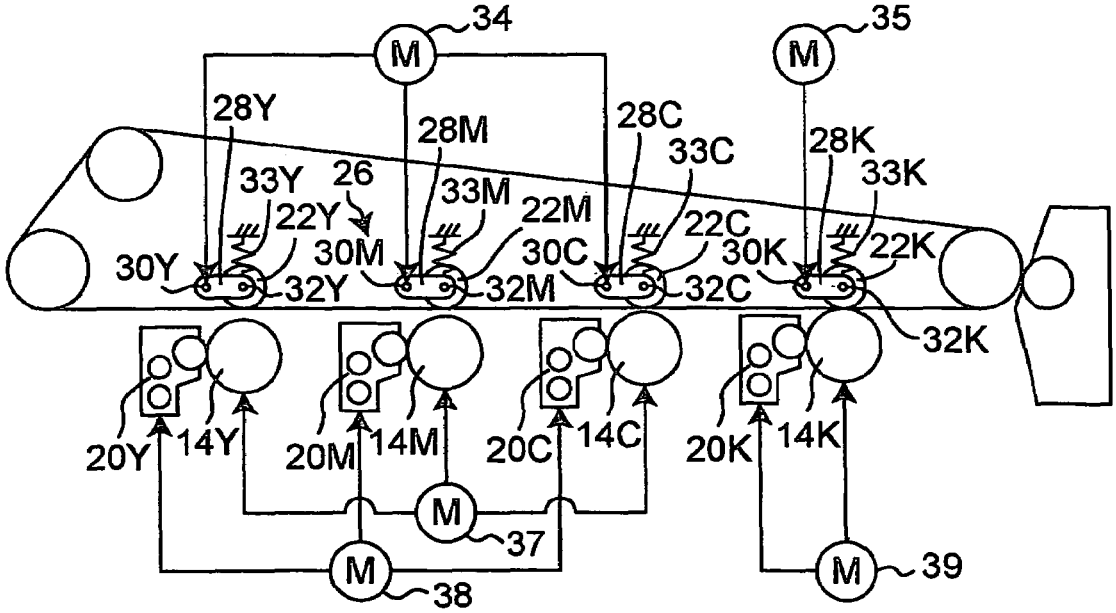
FIG. 3 is a partial view of FIG. 1 showing a separate state where three photoreceptor drums are separate from the intermediate transfer belt.

Referring in particular to FIGS. 2 and 3 each showing a partial view of FIG. 1, each of the primary transfer rollers 22Y, 22M, 22C and 22K is designed to be moved via a switch unit or switch mechanism 26 between a position in which it is in pressure contact with the intermediate transfer belt 4 and a position in which it is separated from the belt 4.

More specifically, the switch mechanism 26 has arms 28Y, 28M, 28C and 28K pivotably about their respective axes 30Y, 30M, 30C and 30K located at one ends thereof. The arms 28Y, 28M, 28C and 28K pivotably support, at its other ends, axes 32Y, 32M, 32C and 32K of the primary transfer rollers 22Y, 22M, 22C and 22K, respectively. Springs 33Y, 33M, 33C and 33K are attached to the axes 32Y, 32M, 32C and 32K in order to bias the primary transfer rollers 22Y, 22M, 22C and 22K pivotally about the axes 30Y, 30M, 30C and 30K in the clockwise direction of the drawings, respectively, allowing the photoreceptor drums 14Y, 14M, 14C and 14K to be brought into pressure contact with the intermediate transfer belt 4.

The axes 30Y, 30M and 30C are operatively connected with a common motor 34 while the axis 30K is with a motor 35. The motors 34 and 35 are connected with a main controller 36 (FIG. 4), which serves to control the printer 2, so that the motors cause the axes 30Y, 30M, 30C and 30K and therefore the arms 28Y, 28M, 28C and 28K to be pivoted in the counterclockwise direction against a biasing force provided by the springs in response to control signals from the main controller 36. As such, the arms 28Y, 28M and 28C can be pivoted around their respective axes independently of the arm 28K. Accordingly, the switch mechanism 26 can switch the photoreceptor drums 14Y–14K between a "pressure contact state" shown in FIG. 2 where all the photoreceptor drums 14Y–14K are in pressure contact with the intermediate transfer belt 4 and a "separate state" shown in FIG. 3 where the drums 14Y, 14M and 14C other than the drums 14K are separated from the belt 4. The switch mechanism 26 may allow all the photoreceptor drums 14Y–14K to be separated from the intermediate transfer belt 4 when the printer 2 is in a waiting state (i.e., it does not perform an image forming operation).

Note that the construction of the switch mechanism 26 is not restrictive of the present invention. For example, the switching between the pressure contact and separate states may be achieved by moving the intermediate transfer belt 4 relative to the photoreceptor drums 14Y–14K.

The photoreceptor drums 14Y, 14M and 14C in the printing units 12Y, 12M and 12C are operatively connected with a common motor 37. The developing rollers (each of which supplies toner to the corresponding photoreceptor drum) or other elements in the developing devices 20Y, 20M and 20C are operatively connected with a common motor 38. Accordingly, the photoreceptor drums 14Y, 14M and 14C can be activated or "idled" while the developing devices 20Y, 20M and 20C are deactivated. On the other hand, the photoreceptor drum 14Y and the developing device 20K in the printing unit 12K are operatively connected with a common motor 39. The motors 37, 38 and 39 are rotated in response to control signals from the main controller 36 (see FIG. 4).

The process members other than the photoreceptor drums and developing devices (e.g. the charging devices, their power supplies) and other aforesaid/after-mentioned elements of the printer 2 (e.g. the drive motor of the roller 10, fixing device, its power supply) are designed to be activated in response to control signals from the main controller 36.

Referring back to FIG. 1, a secondary transfer roller 40 is pressured against the intermediate transfer belt 4 at a portion thereof that is supported by the roller 10. The secondary transfer roller 40 and the intermediate transfer belt 4 define a nip region 42.

The printer 2 has a sheet supply cassette 44 detachably mounted at the bottom part thereof for accommodating one or more sheets (recording media) S. A feed roller 46 is located above and adjacent to the lead edge of the sheets S in the sheet supply cassette 44 so that the feed roller 46 rotates and feeds the sheets one by one, starting with the top sheet, from the cassette 44 to a transport path 48.

The transport path 48 extends from the sheet supply cassette 44, through a nip region of a pair of timing rollers 50, the secondary transfer region 42, a fixing device 52, and a nip region of a pair of discharge rollers 54 to a discharge portion 56 located on an upper surface of the printer 2.

Figure 4:
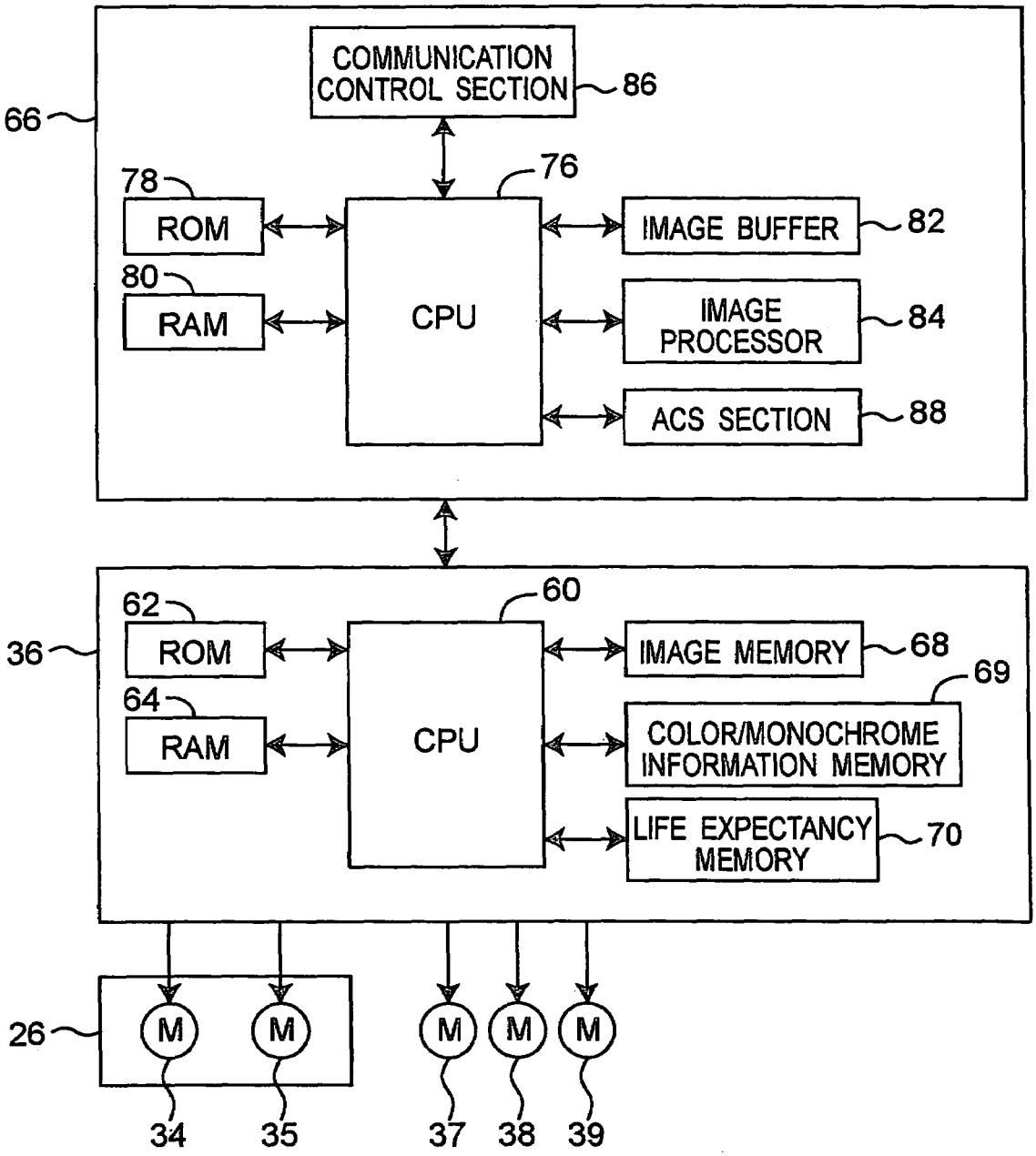
FIG. 4 is a control block diagram of the image forming device of FIG. 1.

Referring to FIG. 4 illustrating a control block diagram of the printer 2, the main controller 36 includes a central processing unit (CPU) 60 such as microprocessor, a read only memory (ROM) 62 for storing control programs of the CPU 60 and various data, a random access memory (RAM) 64 which provides a work area of the CPU 60. The main controller 36 also includes an image memory 68 for storing image data representative of one document transmitted from a printer controller 66 (described in detail below). The main controller 36 further includes memories 69 and 70. The memory 69 is used for storing information as to whether image data representative of one document is color image data or monochrome image data. The memory 70 is used for storing life expectancies of the process members of the printing units 12Y–12K, i.e. the photoreceptor drums 14Y–14K and the developing devices 20Y–20K. Herein, the life expectancy of each photoreceptor drum 14Y, 14M, 14C or 14K designates a predetermined life time thereof in an unused condition subtracted by an operating time of the photoreceptor drum that is determined based on, for example, total amount of rotation, total rotation time or number of documents that have been printed. Likewise, the life expectancy of each developing device 20Y, 20M, 20C or 20K designates a predetermined life time thereof in an unused condition subtracted by an operating time of the developing device that is determined based on, for example, total amount of rotation, total rotation time of its developing roller or number of documents that have been printed. The CPU 60 rewrites at an adequate timing each life expectancy stored in the life expectancy memory 70.

Each of the photoreceptor drums 14Y–14K includes a drum body on which a thin layer (having a thickness of, for example, 30 μm) is provided for forming a latent image. The photoreceptor drums 14Y–14K are in pressure contact with the cleaning blades of the corresponding cleaning devices 24Y–24K. As a result, the image forming operation causes the thickness of the thin layer of the photoreceptor drum to become smaller. When the thickness reaches, for example, about 10 μm, a latent image can not be formed on the photoreceptor drum, meaning that the life of the drum is expired. On the other hand, the developer is circulated in each of the developing devices 20Y–20K in case where it is two-component developer consisting of toner and carrier. The friction during the circulation leads to a deterioration of the carrier. When the deterioration reaches a certain point, the developing device can not perform a developing operation, meaning that the life of the device is expired. There is a tendency that the degradation of the developing device due to the deterioration of the developer is faster than that of the photoreceptor drum due to the decrease of the thickness of the thin layer thereof (This tendency is more significant when the amount of developer that can be loaded in the developing device is smaller). Therefore, with regard to each of the printing units 12Y–12K, the lifetime in a unused condition of the developing device is set to be shorter than that of the photoreceptor drum.

The printer controller 66 functions to receive a print job transmitted from an external terminal (e.g. personal computer, server) via a network (e.g. LAN) to the printer 2. The print job includes, for example, RGB image data representative of documents to be printed and the number of the documents. The printer controller 66 and the main controller 36 constitute a control section of the printer 2. The printer controller 66 includes a CPU 76, a ROM 78 for storing control programs of the CPU 76 and various data, a RAM 80 which provides a work area of the CPU 76. The printer controller 66 also includes an image buffer 82, an image processor 84 and a communication control section 86. The image buffer 82 is used for storing the image data from the external terminal. The image processor 84 is used for performing various image processing operations including conversion from the RGM image data to YMCK image data. The communication control section 86 serves to communicate with the external terminal.

The printer controller 66 further includes an auto color select (ACS) section 88 for determining whether each document to be printed is color or monochrome. More specifically, the ACS section 88 calculates the saturation of each pixel in each document based on the red (R), green (G) and blue (B) components in order to determine whether the pixel is a chromatic color pixel or an achromatic color pixel. The ACS section 88 then determines whether each document is color or monochrome based on a ratio of the number of chromatic (or achromatic) color pixels to the total pixel number of the document. For instance, when a ratio of the number of the chromatic color pixels to the total pixel number of one document is equal to or more than 0.1%, it is determined that the document is color. The printer controller 66 is designed to send both information on the color/monochrome determination and the YMCK image data to the main controller 36 document by document. In the main controller 36, the color/monochrome determination information and the YMCK image data are temporarily stored in the color/monochrome information memory 69 and the image memory 68, respectively.

Figure 5:
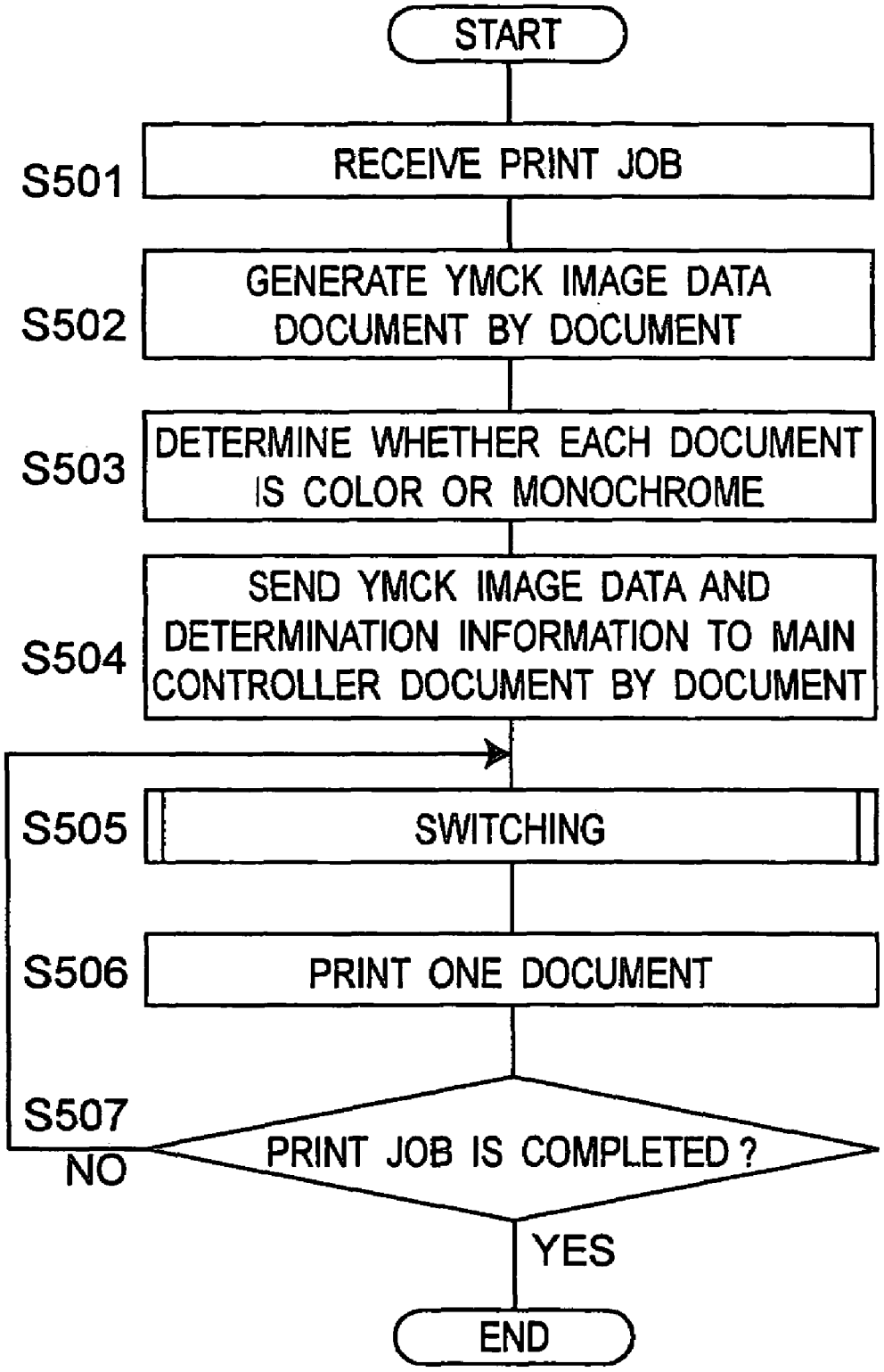
FIG. 5 is a flow chart illustrating an image forming operation carried out by the image forming device of FIG. 1.
Figure 6:
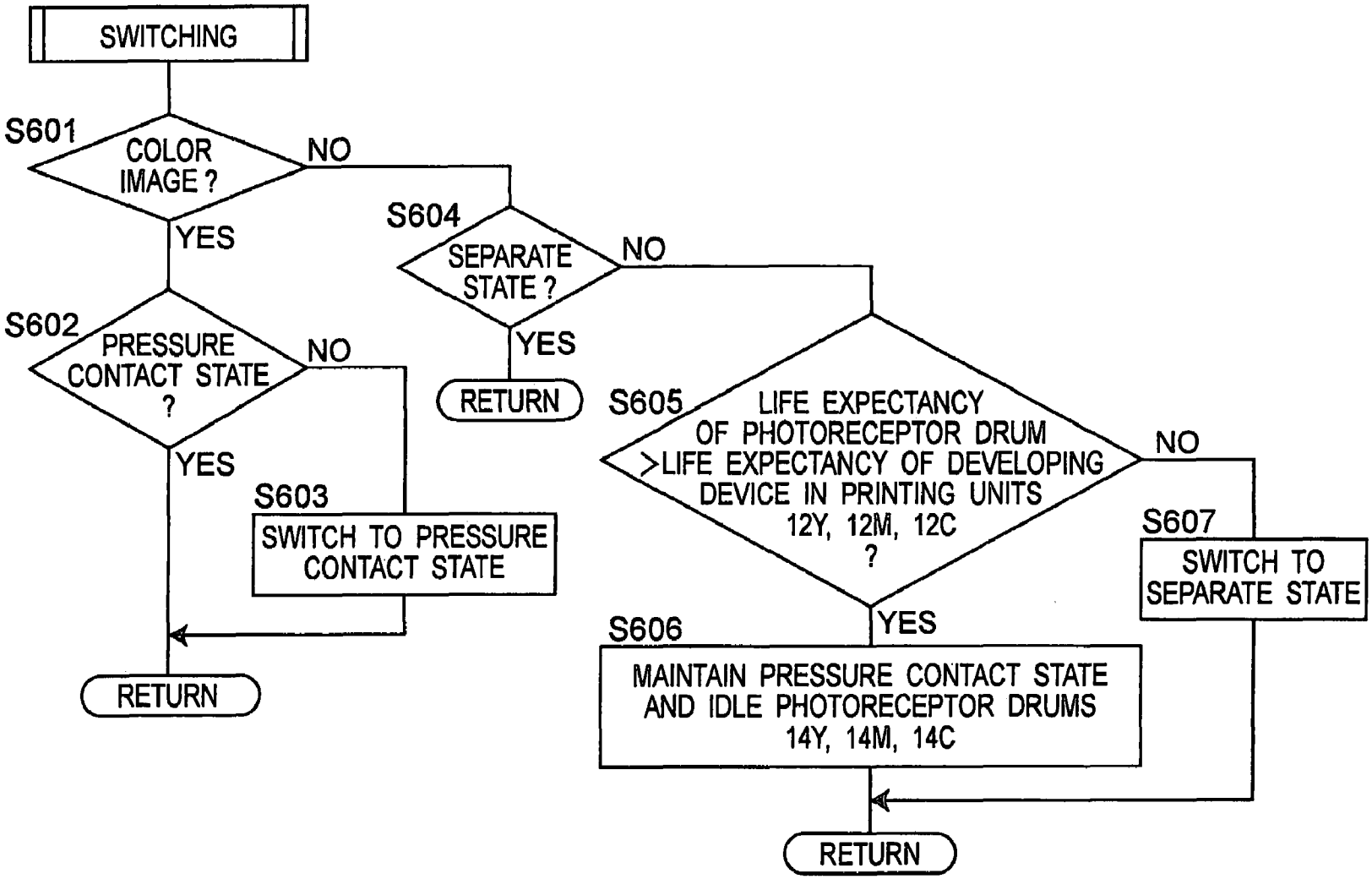
FIG. 6 is a flow chart illustrating the subroutine of the switching operation in FIG. 5.
Figure 7:
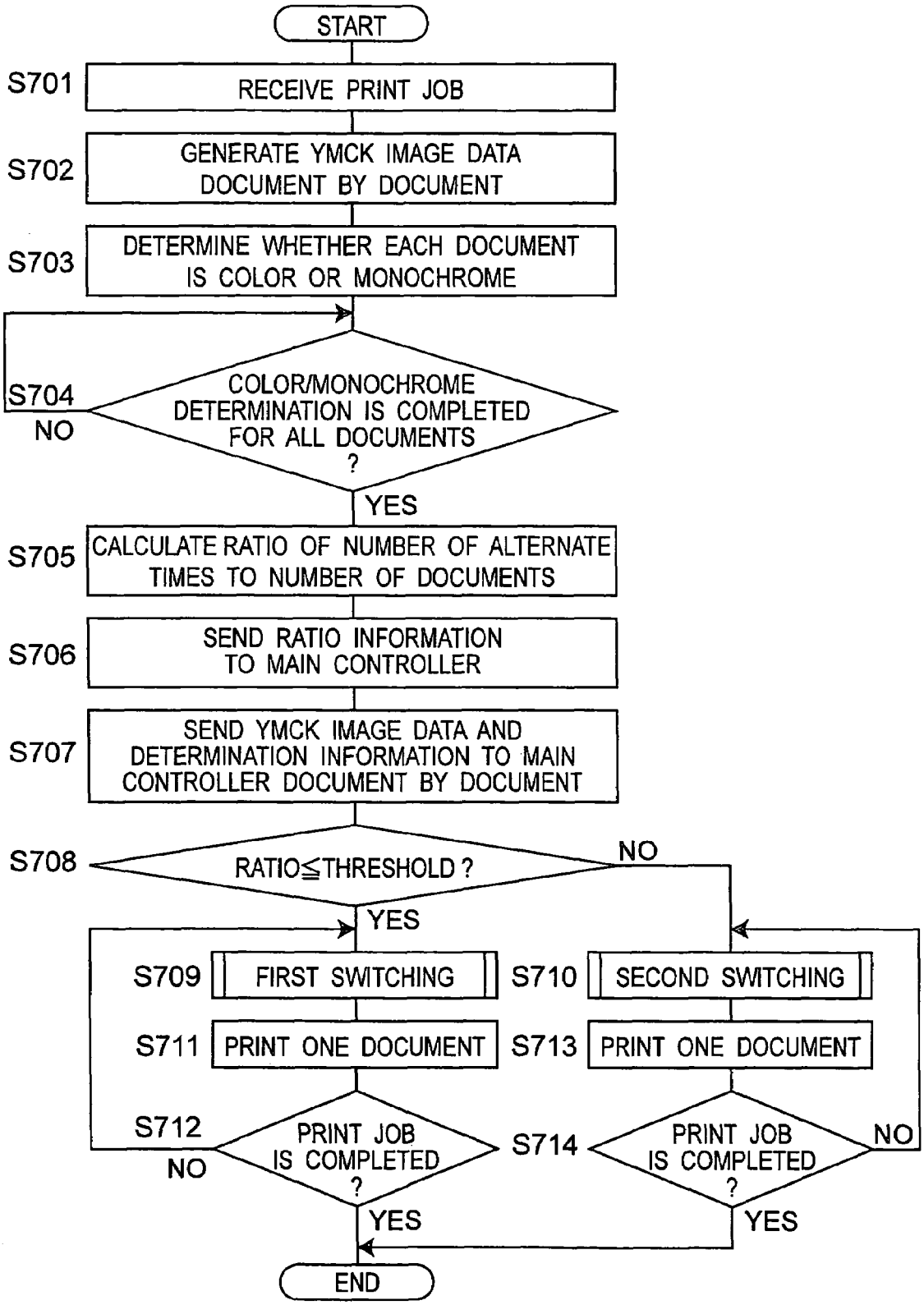
FIG. 7 is a flow chart illustrating an image forming operation carried out by a second embodiment of the image forming device according to the present invention.
Figure 8:
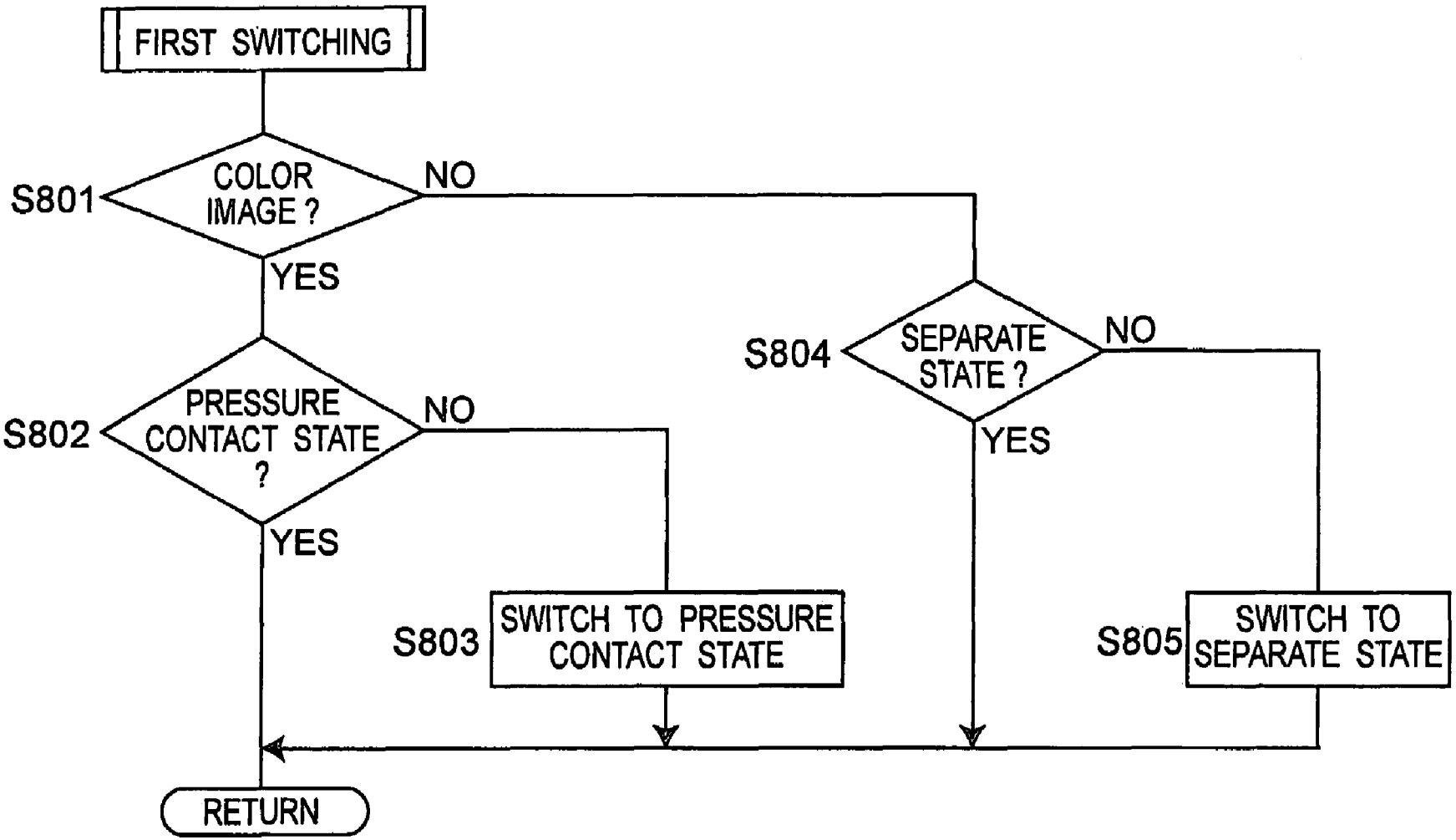
FIG. 8 is a flow chart illustrating the subroutine of the first switching operation in FIG. 7.

FIGS. 5 and 6 illustrate an image forming operation performed by the printer 2 of the present embodiment. Referring also to FIGS. 1–4, an RGB image signal representative of a given number of documents is first transmitted from the external terminal to the printer controller 66 in the printer 2 (i.e., the printer 2 receives a print job) (step 501), the image processor 84 generates YMCK image data consisting of yellow, magenta, cyan and black components document by document and the YMCK image data is stored in the image buffer 82 (step 502). At step 503, the ACS section 88 determines whether each document is color or monochrome based on the RGB image signal, as described above. At step 504, the printer controller 66 sends the YMCK image data and the color/monochrome determination information to the main controller 36 document by document, so that the YMCK image data and the determination information are temporarily stored in the image memory 68 and the color/monochrome information memory 69, respectively.

At step 505, the photoreceptor drums 14Y–14K are switched between the pressure contact and the separate states. This process will be described in detail with reference to a subroutine of FIG. 6.

At step 601, the main controller 36 checks the color/monochrome determination information stored in the memory 69 in order to make a determination as to whether the YMCK image data stored in the image memory 68 is color image data. If the determination is affirmative, the process moves to step 602. At step 602, a determination is made as to whether all the photoreceptor drums 14Y–14K are in pressure contact with the intermediate transfer belt 4. If the determination is affirmative, the process returns to step 506 in FIG. 5, where a color image forming operation is performed.

Specifically, the main controller 36 generates control signals in response to the color image data stored in the image memory 68 and then transmits them to the exposing devices 18Y–18K in the printing units 12Y–12K. The exposing devices 18Y–18K selectively emit laser beams onto the photoreceptor drums 14Y–14K, so that latent images for yellow, magenta, cyan and black are formed on the drums 14Y–14K, respectively.

The latent images on the photoreceptor drums 14Y–14K are visualized by means of the developing devices 20Y–20K to form yellow, magenta, cyan and black toner images, respectively. The primary transfer rollers 22Y–22K cause the toner images to be transferred one by one onto the intermediate transfer belt 4 which is rotated in the counterclockwise direction in FIG. 1 and in pressure contact with the photoreceptor drums 14Y–14K, so that the toner images are superimposed one on top the other.

The superimposed toner images are transported by the movement of the intermediate transfer belt 4 to the secondary transfer region 42. On the other hand, a sheet S is fed from the sheet supply cassette 44 to the transport path 48 and then supplied by the pair of timing rollers 50 to the secondary transfer region 42. Thus, the superimposed toner images are transferred by means of the secondary transfer roller 40 onto the sheet S moving past the secondary transfer region 42. Note that the residual toners on the intermediate transfer belt 4 after the secondary transfer process are removed with a cleaning member not shown.

The sheet S onto which the color toner image has been transferred is supplied along the transport path 48 to the fixing device 52, where the color toner image is fixed on the sheet S. Finally, the sheet S is discharged via the pair of discharge rollers 54 onto the discharge portion 56.

Thereafter, the process moves to step 507, where a determination is made as to whether there is a next document to be printed. If the determination is affirmative, the process returns to step 505. If negative, the process is done.

Referring again to FIG. 6, at step 602, if the determination is negative, i.e., the photoreceptor drums 14Y, 14M and 14C are separated from the intermediate transfer belt 4, the process moves to step 603, where the main controller 36 controls the switch mechanism 26 to bring the photoreceptor drums 14Y, 14M and 14C in pressure contact with the intermediate transfer belt 4. Then, the process moves to step 506, where a color toner image is formed on a sheet S, as described above. At step 603, in case where a first document is to be printed and the printer 2 is in the waiting state (i.e., all the photoreceptor drums 14Y–14K are separated from the intermediate transfer belt 4), all the drums 14Y–14K are brought into pressure contact with the belt 4.

At step 601, if the determination is negative, i.e., the YMCK image data stored in the image memory 68 is monochrome image data, the process moves to step 604. At step 604, a determination is made as to whether the photoreceptor drums 14Y, 14M and 14C other than the drum 14K are separated from the intermediate transfer belt 4. If the determination is affirmative, the process moves to step 506 in FIG. 5, where a monochrome image forming operation is performed. In case where a first document is to be printed and the printer 2 is in the waiting state (i.e., all the photoreceptor drums 14Y–14K are separated from the intermediate transfer belt 4), the drum 14K is brought into pressure contact with the belt 4 before the process moves to step 506.

At step 506, the main controller 36 generates a control signal in response to the monochrome image data stored in the image memory 68 and then transmits it to the exposing device 18K in the printing unit 12K. The exposing device 18K selectively emits laser beam onto the photoreceptor drum 14K, so that a latent image for black is formed on the drum 14K.

The latent image on the photoreceptor drum 14K is visualized by means of the developing device 20K to form a black toner image. The primary transfer roller 22K causes the toner image to be transferred onto the intermediate transfer belt 4 which is rotated in the counterclockwise direction in FIG. 1 and in pressure contact with the photoreceptor drum 14K.

The monochrome toner image is transported by the movement of the intermediate transfer belt 4 to the secondary transfer region 42. On the other hand, a sheet S is fed from the sheet supply cassette 44 to the transport path 48 and then supplied by the pair of timing rollers 50 to the secondary transfer region 42. Thus, the monochrome toner image is transferred by means of the secondary transfer roller 40 onto the sheet S moving past the secondary transfer region 42.

The sheet S onto which the monochrome toner image has been transferred is supplied along the transport path 48 to the fixing device 52, where the monochrome toner image is fixed on the sheet S. Finally, the sheet S is discharged via the pair of discharge rollers 54 onto the discharge portion 56.

At step 604 in FIG. 6, if the determination is negative, i.e., all the photoreceptor drums 14Y–14K are in pressure contact with the intermediate transfer belt 4, the process moves to step 605. At step 605, the main controller 36 checks the life expectancy memory 70 to compare the life expectancies of the photoreceptor drum and the developing device with regard to each of the printing units 12Y, 12M and 12C.

If the life expectancy of the photoreceptor drum is longer than that of the developing device with regard to all the printing units 12Y, 12M and 12C, the main controller 36 does not control the switch mechanism 26 to switch the photoreceptor drums 14Y, 14M and 14C to the separate state (i.e., the pressure contact state is maintained). Instead, the main controller 36 causes the photoreceptor drums 14Y, 14M and 14C to activate or rotate and, at the same time, the developing devices 20Y, 20M and 20C and other process members to deactivate (step 606). Then, the process moves to step 506 in FIG. 5, where a monochrome image forming operation is performed as described above.

As such, where the life expectancy of the photoreceptor drum is longer than that of the developing device and a monochrome document is to be printed, an image forming operation is carried out without switching to the separate state if the photoreceptor drums have been in the pressure contact state in the printing of the previous document. Accordingly, in the embodiment, an image forming operation needs not to be delayed until a vibration of the intermediate transfer belt 4 which would be generated due to the switching operation was attenuated. Also, where a color document is printed after a monochrome document, since the photoreceptor drums are in the pressure contact state in a printing of the monochrome document, the switching operation is not necessary (see step 602). Therefore, the present embodiment enables an image of high quality to be formed without reducing productivity of the printer even where monochrome document(s) and color document(s) are alternately printed.

In general, the life expectancy of a photoreceptor drum in an unused condition is set to be longer than that of the corresponding developing device. As a result, where the photoreceptor drum and the developing device are incorporated in a unit (i.e. unitized), when the life of the developing device is expired, the unit must be replaced with a new one although the drum is still usable, leading to a waste of resources.

In contrast, in the embodiment, the differences in lifetime between the photoreceptor drums 14Y, 14M and 14C and the developing devices 20Y, 20M and 20C are utilized to make most use of the lifetime of the drums at the same time that productivity reduction is prevented. This is achieved by allowing the photoreceptor drums 14Y, 14M and 14C to be kept in pressure contact with the intermediate transfer belt 4 in case where a monochrome document is to be printed after a color document, if the life expectancy of each of the drums 14Y, 14M and 14C is longer than that of each of the devices 20Y, 20M and 20C.

At step 605, where the life expectancy of the photoreceptor drum is equal to or shorter than that of the developing device with regard to either one of the printing units 12Y, 12M and 12C, the process moves to step 607. Note that at this time all the photoreceptor drums 14Y–14K are in pressure contact with the intermediate transfer belt 4. At step 607, the main controller 36 controls the switch mechanism 26 so that the photoreceptor drums 14Y, 14M and 14C other than the drum 14K are separated from the intermediate transfer belt 4. Thereafter, the process moves to step 506 in FIG. 5, where a monochrome image forming operation is performed as described above.

As such, in the embodiment, where the life expectancy of the photoreceptor drum is equal to or shorter than that of the developing device, a monochrome image is formed in the same manner as in a conventional apparatus, i.e., only the photoreceptor drum 14K is in pressure contact with the intermediate transfer belt 4. Therefore, the further decrease in the life expectancies of the photoreceptor drums 14Y, 14M and 14C due to the idling of the drums in pressure contact with the intermediate transfer belt 4 can be prevented. Accordingly, the lifetimes of the developing devices 20Y, 20M and 20C can be made effectively use of. In other words, the life of a photoreceptor drum does not be expired before much of the lifetime of the corresponding developing device is used.

As is apparent from the description of the flow chart, once the life expectancies of the photoreceptor drum and the developing device with regard to either one of the printing units 12Y, 12M and 12C are generally the same, the pressure contact state is selected in the printing of a color document and, on the other hand, the separate state is selected in the printing of a monochrome document. However, since a reduction rate of the life expectancy of the developing device is in general faster than that of the photoreceptor drum, there may be a case where the life expectancy of the drum becomes longer than that of the developing device again. In this condition, where a monochrome image is to be formed, the pressure contact state is maintained if the previous document has been printed in the pressure contact state.

In the flow chart, although a determination is made at step 605 as to whether a value of the life expectancy of the developing device subtracted from the life expectancy of the photoreceptor drum is more than zero, the value may be compared with a predetermined threshold other than zero. The threshold may be less than zero.

As described above, there may be a case where a value of the life expectancy of the developing device subtracted from the life expectancy of the photoreceptor drum is once less than a threshold (e.g. zero) and becomes more than the threshold again. Once the value becomes more than the threshold again, the threshold may be replaced with a new smaller one at step 605.

Second Embodiment

An image forming device of a second embodiment according to the present invention will now be described. The image forming device is a printer similar to the printer 2 shown in FIGS. 1–4 except that, in case of a print job including more than one documents, the printer controller 66 calculates how many times color document(s) and monochrome document(s) are alternated in the order of printing and then calculates a ratio of the "number of alternate times" to the number of the documents. The number of alternate times is stored in the color/monochrome information memory 69 in the main controller 36.

More specifically, with reference to FIGS. 1, 4 and 7–9, an RGB image signal representative of a given number of documents is first transmitted from the external terminal to the printer controller 66 in the printer 2 (step 701), the image processor 84 generates YMCK image data consisting of yellow, magenta, cyan and black components document by document and the image data is stored in the image buffer 82 (step 702). At step 703, the ACS section 88 determines whether each document is color or monochrome based on the RGB image signal, as described above.

At step 704, a determination is made as to whether the determination at step 703 is completed for all documents. If the determination is affirmative, the CPU 76 in the printer controller 66 calculates how many times color image(s) and monochrome image(s) are alternated in the order of printing based on the color/monochrome determination information and then a ratio of the number of alternate times to the number of documents (step 705). For instance, where one or more color documents are followed by one or more monochrome documents and then one or more color documents in the order of printing, the number of alternate times is two. Thus, where the number of documents is one hundred, the ratio is 0.02. As described above, the information on the number of documents is included in the print job. At step 706, the printer controller 66 sends the ratio information to the main controller 36, so that the information is stored in the color/monochrome information memory 69.

Then, at step 707, the printer controller 66 sends the YMCK image data and the color/monochrome determination information to the main controller 36 document by document, so that the YMCK image data and the determination information are temporarily stored in the image memory 68 and the color/monochrome information memory 69, respectively.

At step 708, the main controller 36 compares the ratio with a predetermined threshold to determine whether the ratio is equal to or less than the threshold. Although the threshold may be any number in the range of 0–1, it is desirably a number as small as possible, preferably equal to or less than 0.1, more preferably equal to or less than 0.05, most preferably equal to or less than 0.03. If the determination is affirmative (i.e. the number of alternate times is relatively small as compared with the number of documents), the process moves to step 709, where a first switching operation is performed. If the determination is negative (i.e. the number of alternate times is relatively large as compared with the number of documents), the process moves to step 710, where a second switching operation is performed.

At step 709, the photoreceptor drums 14Y–14K are switched between the pressure contact and the separate states as described hereinafter. With reference to a subroutine of the first switching operation shown in FIG. 8, the main controller 36 checks the color/monochrome determination information stored in the memory 69 in order to make a determination as to whether the YMCK image data stored in the image memory 68 is color image data (step 801). If the determination is affirmative, the process moves to step 802. At step 802, a determination is made as to whether all the photoreceptor drums 14Y–14K are in pressure contact with the intermediate transfer belt 4. If the determination is affirmative, the process returns to step 711 in FIG. 7, where a color image forming operation is performed as described above.

Thereafter, the process moves to step 712, where a determination is made as to whether there is a next document to be printed. If the determination is affirmative, the process returns to step 709. If negative, the process is done.

Referring again to FIG. 8, at step 802, if the determination is negative, i.e., the photoreceptor drums 14Y, 14M and 14C other than the drum 14K are separated from the intermediate transfer belt 4, the process moves to step 803, where the main controller 36 controls the switch mechanism 26 to bring the photoreceptor drums 14Y, 14M and 14C in pressure contact with the intermediate transfer belt 4. Then, the process moves to step 711, where a color image forming operation is performed as described above.

At step 801, if the determination is negative, i.e., the YMCK image data stored in the image memory 68 is monochrome image data, the process moves to step 804. At step 804, a determination is made as to whether the photoreceptor drums 14Y, 14M and 14C other than the drum 14K are separated from the intermediate transfer belt 4. If the determination is affirmative, the process moves to step 711 in FIG. 7, where a monochrome image forming operation is performed as described above. At step 804, if the determination is negative, i.e., all the photoreceptor drums 14Y–14K are in pressure contact with the intermediate transfer belt 4, the process moves to step 805. At step 805, the main controller 36 controls the switch mechanism 26 to separate the photoreceptor drums 14Y, 14M and 14C other than the drum 14K from the intermediate transfer belt 4. Then, the process moves to step 711 in FIG. 7, where a monochrome image forming operation is performed as described above.

In the embodiment, if the number of alternate times is relatively small as compared with the number of documents, productivity reduction due to the switching operation carried out by the switch mechanism 26 is considered as slight. For example, the numbers of documents and alternate times are one hundred and two, respectively, a time loss is relatively small even where the separate state is selected for the printing of a monochrome document and the pressure contact state for the printing of a color document. Therefore, in such a case, the switching is performed so that all the photoreceptor drums 14Y–14K are in pressure contact with the intermediate transfer belt 4 in the printing of a monochrome document and, on the other hand, only the drum 14K is in pressure contact with the belt 4 in the printing of a color document. This has an advantage that the decrease in the life expectancies of the photoreceptor drums 14Y, 14M and 14C is as small as possible in comparison with the first embodiment in which the drums 14Y–14M and 14C are in pressure contact with the intermediate transfer belt 4 where a monochrome image is formed regardless of the number of alternate times.

Figure 9:
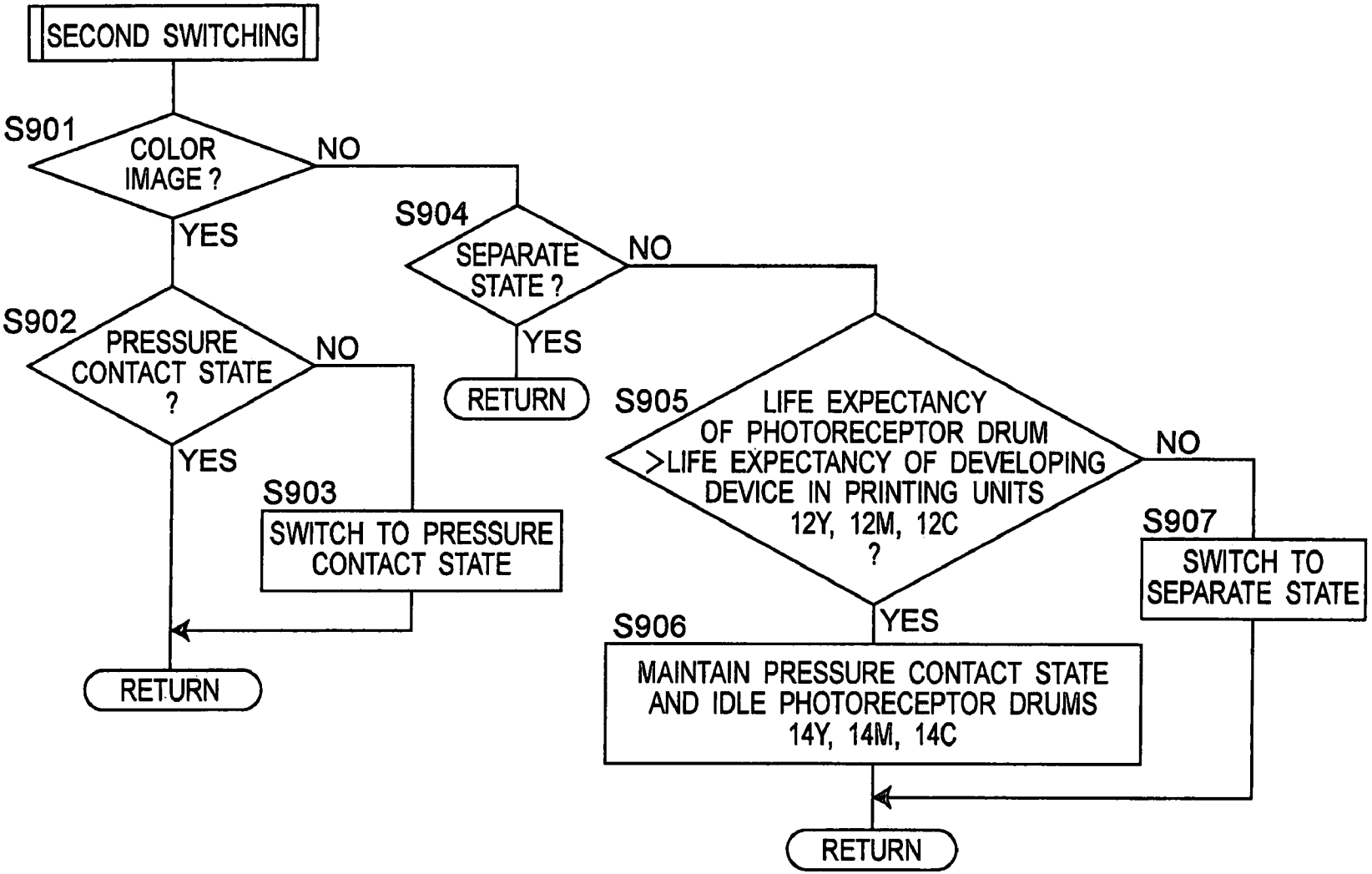
FIG. 9 is a flow chart illustrating the subroutine of the second switching operation in FIG. 7.

Referring back to FIG. 7, at step 710, the photoreceptor drums 14Y–14K are switched between the pressure contact and the separate states as described hereinafter. FIG. 9 shows a subroutine of the second switching operation. Steps 901–907 in the subroutine are identical to steps 601–607 in the subroutine of FIG. 6 according to the first embodiment: In case of a color document, after all the photoreceptor drums 14Y–14K are brought into pressure contact with the intermediate transfer belt 4 (steps 901–903), a color image forming operation is performed (step 713 in FIG. 7). Thereafter, a determination is made as to whether there is a next document to be printed (step 714). If the determination is affirmative, the process returns to step 710. If negative, the process is done. If a monochrome document is to be printed and the photoreceptor drums 14Y, 14M and 14C other than the drum 14K are separated from the intermediate transfer belt 4 in a printing of the previous document (steps 901 and 904), a monochrome image forming operation is performed without the switching process (step 713). If a monochrome document is to be printed and the previous document has been printed in the pressure contact state, the life expectancy of the photoreceptor drum is compared with that of the developing device with regard to the printing units 12Y, 12M and 12C (steps 904 and 905). If the life expectancy of the photoreceptor drum is longer than that of the developing device with regard to all the printing units 12Y, 12M and 12C, a monochrome image forming operation is performed without switching the photoreceptor drums 14Y, 14M and 14C from the pressure contact state in the printing of the previous document to the separate state (steps 905, 906 and 713). If the life expectancy of the photoreceptor drum is equal to or shorter than that of the developing device in either one of the printing units 12Y, 12M and 12C, a monochrome image forming operation is performed after the photoreceptor drums have been switched from the pressure contact state in the printing of the previous document to the separate state (steps 905, 907 and 713).

As such, in the embodiment, if the number of alternate times between monochrome and color is relatively large as compared with the number of documents, a switching operation similar to that of the first embodiment is performed because the productivity would be otherwise reduced if the switch mechanism 26 switched the states each time a kind of document to be printed (color or monochrome) is changed. Accordingly, the productivity of the printer can be maintained where a print job is executed in which color document(s) and monochrome document(s) are repeatedly alternated in the order of printing.

In the flow chart, although the ratio of the number of alternate times to the number of documents is compared with a predetermined threshold at step 708, a determination may be made as to whether there is a predetermined relationship between the number of alternate times and the number of documents, which is included within the scope of the invention. In this case, the sequential steps are modified as follows:

1) Where the determination is affirmative, the main controller 36 controls the switch mechanism 26 so that all the photoreceptor drums 14Y–14K are in pressure contact with the intermediate transfer belt 4 in the printing of a color document and, on the other hand, the drums 14Y, 14M and 14C other than the drum 14K are separated from the belt 4 in the printing of a monochrome document.

2) Where the determination is negative, the main controller 36 controls the switch mechanism 26 so that the pressure contact state is selected regardless of a kind of document to be printed (color or monochrome) if the life expectancy of the photoreceptor drum is longer than that of the developing device with regard to all the printing units 12Y, 12M and 12C. In addition, if a document to be printed is monochrome, the developing devices 20Y, 20M and 20C are deactivated. On the other hand, if the life expectancy of the photoreceptor drum is equal to or shorter than that of the developing device with regard to either one of the printing units 12Y, 12M and 12C, the main controller 36 controls the switch mechanism 26 so that the pressure contact state is selected in the printing of a color document and the separate state in the printing of a monochrome document.

There have been described in detail for preferred embodiments of the image forming apparatus according to the present invention, but it is to be understood that various modifications can be effected within the spirit and scope of the invention.

For example, although in the previous embodiments toner image(s) are first transferred onto the intermediate transfer belt 4 and then onto a sheet S, toner image(s) may be directly transferred onto a sheet which is transported on a transfer member such as intermediate transfer belt.

Also, although in the previous embodiments the ACS section 88 determines whether each document is color or monochrome, the image forming apparatus may be designed so that a user can input such color/monochrome determination information.

Included within the scope of the present invention is an image forming apparatus that utilizes the difference in lifetime between the image bearing member (e.g. photoreceptor drum) and a process member other than the developing device which cooperates with the image bearing member in an image forming process. For example, a cleaning blade of the cleaning device which is a process member is designed to be moved between a first state where it bears against the surface of the image bearing member and a second state where it is separated from the image bearing member. The life expectancies of the image bearing member and the cleaning device (which is mainly determined based on an operating time of the cleaning blade) are stored in a memory. A switch unit is controlled based on the life expectancies to select a contact state where all the image bearing members are in contact with the transfer member or a separate state where all the image bearing member(s) other than the image bearing member in the printing unit used for forming a monochrome image are separated from the transfer member. A determination is made as to whether the life expectancy of the image bearing member is longer than that of the cleaning device in each of the printing units for yellow, magenta and cyan, for example. If the determination is affirmative and the image bearing members for yellow, magenta and cyan have been in contact with the transfer member in a printing of the previous document, a monochrome image (in this case black image) is formed in the contact state. In the process, in each of the printing units for yellow, magenta and cyan, the cleaning blade is separated from the image bearing member in order to prohibit the cleaning device from cooperating with the image bearing member.

What is claimed is:

1. An image forming apparatus, comprising:

a plurality of printing units, each including an image bearing member for rotation about an axis and a process member which cooperates with the image bearing member in an image forming process;

a transfer member for moving in contact with the image bearing member of each of the plurality of printing units, an image on each of the image bearing members being transferred onto the transfer member or a recording medium that is transported on the transfer member;

a switch unit for switching between a contact state where the image bearing members in the plurality of printing units are in contact with the transfer member and a separate state where all but one of the image bearing member(s) in the printing unit(s) are separated from the transfer member;

a memory for storing life expectancies of the image bearing member and the process member with regard to the printing unit(s) other than said one of the image bearing members in the printing units; and a control section for controlling the switch unit based on a print job and the life expectancies stored in the memory.

2. The image forming apparatus in accordance with claim 1, wherein the process member is a developing device for supplying developer to the corresponding image bearing member in an image forming process.

3. The image forming apparatus in accordance with claim 1, wherein the control section includes a determining section for making a determination as to whether each document to be printed is color or monochrome based on the print job corresponding to a plurality of documents; and wherein the control section controls the switch unit based on the determination made by the determination section and the life expectancies stored in the memory.

4. The image forming apparatus in accordance with claim 3, wherein, if a value of the life expectancy of the process member subtracted from the life expectancy of the image bearing member is more than a predetermined threshold with regard to each of the printing unit(s) other than said one of the image bearing members in the printing units, the control section (a) controls the switch unit so that the contact state is selected and (b) controls the process member(s) in the printing unit(s) other than said one of the image bearing members in the printing units to prohibit said process member(s) from cooperating with the corresponding image bearing member(s) where the determining section determines that a document to be printed is monochrome.

5. The image forming apparatus in accordance with claim 4, wherein, if said value is equal to or less than said predetermined threshold with regard to each of the printing unit(s) other than said one of the image bearing members in the printing units, the control section controls the switch unit so that the contact state is selected where the determining section determines that a document to be printed is color and the separate state is selected where the determining section determines that a document to be printed is monochrome.

6. The image forming apparatus in accordance with claim 1, wherein the control section includes a determining section for making a determination as to whether each document to be printed is color or monochrome based on the print job corresponding to a plurality of documents; and wherein the control section calculates the number of times color document(s) and monochrome document(s) are alternated in the order of printing in the print job based on the determination made by the determining section, if the number of alternate times and the number of documents satisfy a predetermined relationship, the control section controls the switch unit so that the contact state is selected where the determining section determines that a document to be printed is color and the separate state is selected where the determining section determines that a document to be printed is monochrome, if the number of alternate times and the number of documents do not satisfy said predetermined relationship and if a value of the life expectancy of the process member subtracted from the life expectancy of the image bearing member is more than a predetermined threshold with regard to each of the printing unit(s) other than said one of the image bearing members in the printing units, the control section (a) controls the switch unit so that the contact state is selected and (b) controls the process member(s) in the printing unit(s) other than said one of the image bearing members in the printing units to prohibit said process member(s) from cooperating with the corresponding image bearing member(s) where the determining section determines that a document to be printed is a monochrome document, and if the number of alternate times and the number of documents do not satisfy said predetermined relationship and if said value is equal to or less than said predetermined threshold with regard to each of the printing unit(s) other than said one of the image bearing members in the printing units, the control section controls the switch unit so that the contact state is selected where the determining section determines that a document to be printed is color and the separate state is selected where the determining section determines that a document to be printed is monochrome.

7. An image forming apparatus, comprising:

a first image bearing member having an electrostatic latent image thereon;

a first developing device for developing the electrostatic latent image on the first image bearing member into a toner image;

a second image bearing member having an electrostatic latent image thereon;

a second developing device for developing the electrostatic latent image on the second image bearing member into a toner image;

a transfer member which moves in contact with the image bearing members, the toner image on each of the image bearing members being transferred onto the transfer member or a recording medium that is transported on the transfer member;

a switching mechanism which switches between a contact state where the first and second image bearing members are in contact with the transfer member and a separate state where the first image bearing member is in contact with the transfer member and the second image bearing member is separated from the transfer member;

a memory for storing life expectancies of the second image bearing member and the second developing device; and a control unit which controls the switch mechanism based on the life expectancies stored in the memory.

8. The image forming apparatus in accordance with claim 7, wherein the control unit includes a determining section for making a determination as to whether document to be formed is color or monochrome based on a print job corresponding to a plurality of documents; and wherein the control unit controls the switch mechanism based on the determination made by the determination section and the life expectancies stored in the memory.

9. The image forming apparatus in accordance with claim 8, wherein, if a value of the life expectancy of the second developing member subtracted from the life expectancy of the second image bearing member is more that a predetermined threshold, the control unit controls the switch mechanism so that the contact state is selected and prohibits the second developing device from cooperating with the second image bearing member where the determining section determines that a document to be formed is monochrome.

10. The image forming apparatus in accordance with claim 7, wherein, if a value of the life expectancy of the second developing member subtracted from the life expectancy of the second image bearing member is more than a predetermined threshold, the control unit controls the switch mechanism so that the contact state is selected.

* * * * *